US005492378A

United States Patent [19]

Bittmann et al.

[11] Patent Number: 5,492,378

[45] Date of Patent: Feb. 20, 1996

[54] DOOR LOCK FOR A MOTOR VEHICLE DOOR

[75] Inventors: Werner Bittmann, Russelsheim; Gerhard Getrost, Gross-Gerau, both of Germany

[73] Assignee: General Motors Corporation, Detroit, Mich.

[21] Appl. No.: 193,362

[22] Filed: Feb. 4, 1994

[30] Foreign Application Priority Data

Feb. 6, 1993 [DE] Germany ..... 4303532

[51] Int. Cl.[6] ..... E05C 3/26

[52] U.S. Cl. ..... 292/229; 292/216; 292/DIG. 23

[58] Field of Search ..... 292/229, DIG. 56, 292/DIG. 73, DIG. 53, 204, 216, DIG. 23

[56] References Cited

U.S. PATENT DOCUMENTS

| | | | |
|---|---|---|---|
| 2,569,043 | 9/1951 | Endter | 292/DIG. 23 |
| 2,622,909 | 12/1952 | Endter | 292/341.13 |
| 2,758,862 | 8/1956 | Endter | 292/DIG. 23 |
| 3,212,803 | 10/1965 | Russell et al. | 292/DIG. 38 |
| 4,854,617 | 8/1989 | Hayakawa et al. | 292/DIG. 56 |
| 5,092,642 | 3/1992 | Lindmayer et al. | 292/DIG. 56 |

FOREIGN PATENT DOCUMENTS

| | | | |
|---|---|---|---|
| 1033085 | 6/1958 | Germany | 292/229 |

*Primary Examiner*—Darnell M. Boucher
*Attorney, Agent, or Firm*—Charles E. Leahy

[57] ABSTRACT

A door lock has a forked latch 3 mounted capable of pivoting about a lock housing 1. It has a truncated conical oval recess 12 into which a component 11 with an also truncated conical oval region engages. A spring 14 presses the forked latch 3 against this component 11. As a result the friction between the forked latch 3 and the component 11 increases when the oval shape of the recess 12 and the component are offset 90° from one another but not when the oval shapes are aligned in the same direction.

2 Claims, 2 Drawing Sheets

DOOR LOCK FOR A MOTOR VEHICLE DOOR

The invention relates to a door lock for a motor vehicle door, which lock has a forked latch capable of pivoting about an axis of a lock housing which is held under tension by a spring in the open position and which engages a locking part when the vehicle door is closed and in which a safety catch activated by a door handle is provided to lock the forked latch in the closed position.

Door locks of the type described are installed in the doors of modern motor vehicles and are therefore generally well known. When the vehicle door is opened the forked latch must point with its opening mouth toward the locking part which is usually designed as a strap so that when the vehicle door closes the forked latch can engage the locking part. When this has happened, then upon further closing movement of the vehicle door the forked latch is pivoted by the locking part and in its end position after the release of the door handle, which may be designed as a handle plate, is blocked by a safety catch. Since the door seals press the closed vehicle door outward, the opening mouth of the forked latch lies with its leg on the inside of the vehicle against the locking part, while the other leg has a slight distance from the locking part because of the play.

If it is desired to open the vehicle door, then first by means of the door handle the safety catch of the forked latch is released. Then the vehicle door jumps out a short distance at a relatively high force. The force in this case is high because the door seals press outward relatively strongly and the forked latch is also under tension in the open position with a relatively high force so that it rapidly and reliably reaches this open position after the opening of the vehicle door. As a result of the high tension force and the rapid opening of the vehicle door the outer leg of its mouth opening is made to impact forcefully against the closing part, which leads to an undesired knocking noise.

The invention has the objective of designing a door lock of the type mentioned initially for a motor vehicle door which avoids knocking noises when the vehicle door is opened in a simple way.

This problem is solved according to the invention by a retarding friction brake which becomes active only immediately before the closed position is reached to delay the pivoting movement of the forked latch.

Such a friction brake initially delays the upward movement of the forked latch when the vehicle door opens. In this way the forked latch overcomes the play of its opening mouth on the locking part at a low speed so that it does not cause a knocking noise due to the impingement of the outer leg of the opening mouth against the closing part. Since the friction brake is active only in the immediate closing region, it does not prevent or delay the pivoting movement of the forked latch in the direction of its open position as soon as a slight initial pivoting angle has been overcome as the door opens. Therefore, despite the friction brake, the forked latch always rapidly and reliably reaches its open position.

Aside from the fact that the friction brake according to the invention prevents knocking noises during the opening of the vehicle door, when traveling on uneven roads it assures by its braking action that no knocking noises will occur in the door lock. It also prevents improper closing in the winter since the forked latch has a longer holding time as a result of the frictional connection. Furthermore when the door closes a more pleasant, less metallic noise is produced.

The friction brake can have a great variety of designs. An especially simple version consists in designing the friction brake as an oval component engaging an oval recess in the forked latch where the maximal diameter of the component is equal to the minimal diameter of the recess.

In the case of the oval component, an axis of oval design may be involved on which the forked latch sits with a boring designed as an oval recess. The forked latch is difficult to swivel when the oval shape of the axis runs transversely to the oval shape of the recess, while the pivotability can be accomplished with less force as soon as the two oval shapes are aligned in the same direction. A disadvantage of such a version, however, is the fact that due to wear the recess becomes wider with time and the axis becomes smaller in cross section. As a result the effect of the friction brake diminishes with time. This can be avoided in a simple way if, according to another version of the invention, the oval-shaped component is a region of a cover plate of the door lock designed as a truncated cone and the recess of the forked latch is accordingly cone shaped so that the forked latch in the closed position of the vehicle door lies with one conical surface of its recess against a corresponding conical surface of the component and if the forked latch is mounted capable of moving with axial limitation relative to the component and is under tension by a spring against the conical surface of the component engaging it. With such a design the friction force of the friction brake can be varied by varying the tension of the spring.

In design terms, the door lock is especially simple if the spring is a disk spring arranged between the lock housing and the forked latch.

The invention permits numerous variations. For illustration of its basic principle, one of them is shown in the drawing and is described in the following. It shows:

Figure 1:
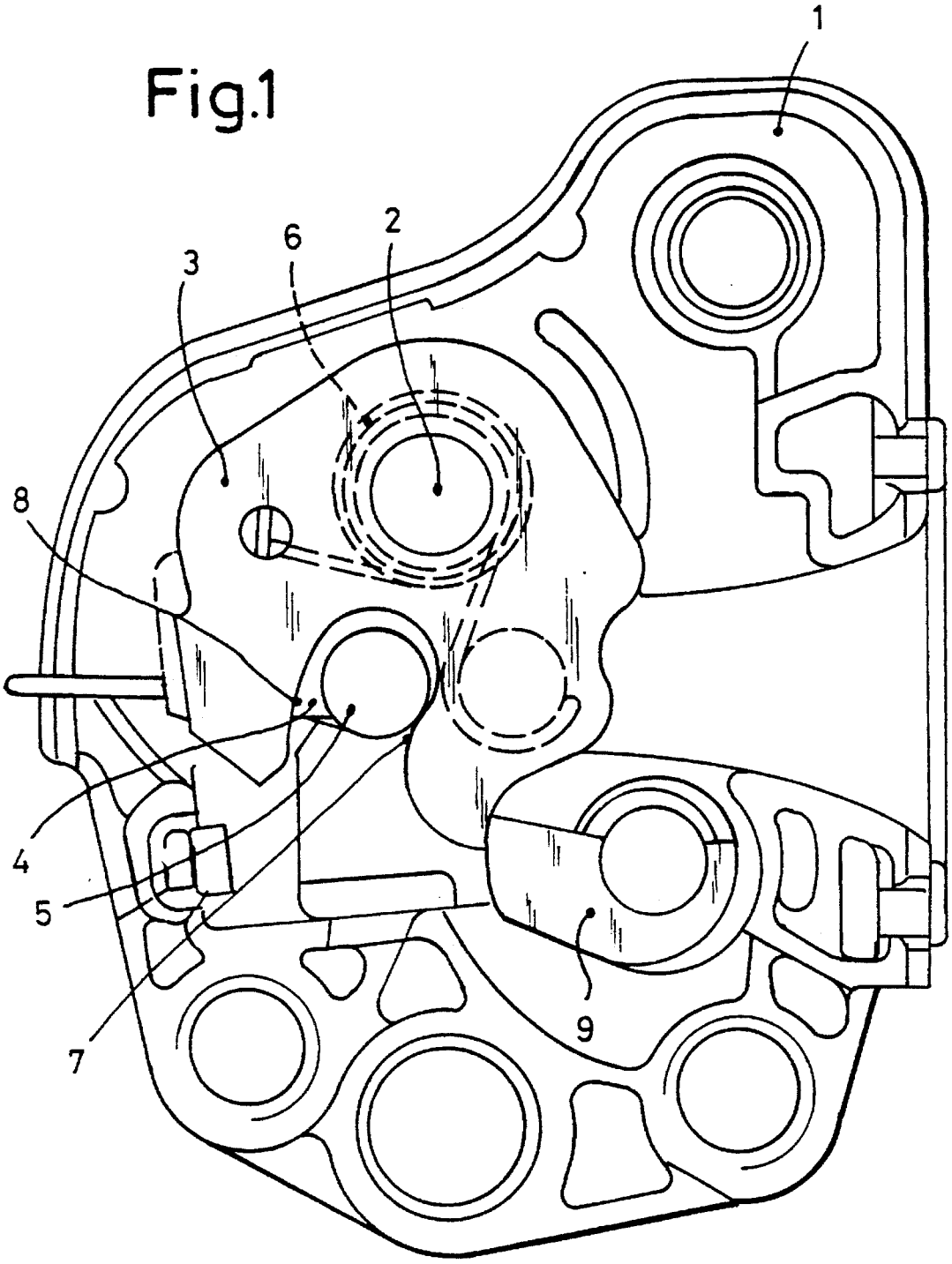
FIG. 1 is a front view of a door lock which may display the features according to the invention.

FIG. 1 shows a lock housing 1 of a door lock which displays a forked latch 3 capable of pivoting about a stationary axis 2. In the closed position shown the forked latch 3 engages with its opening mouth 4 a locking part 5 usually designed as a strap or bolt which extends out of a door beam, not shown, into the door opening. A spring 6 designed as a leg spring shown by broken lines in the figure holds the forked latch 3 under tension in the counterclockwise direction. With the door closed it lies with one leg 7 of the opening mouth 4 against the locking part 5 while the opposite outer leg 8 has a slight distance from the axis 2. A safety catch 9 which is mechanically connected to a door handle, not shown, engages the forked latch 3 when the vehicle door is closed in such a way that the forked latch cannot pivot.

Figure 2:
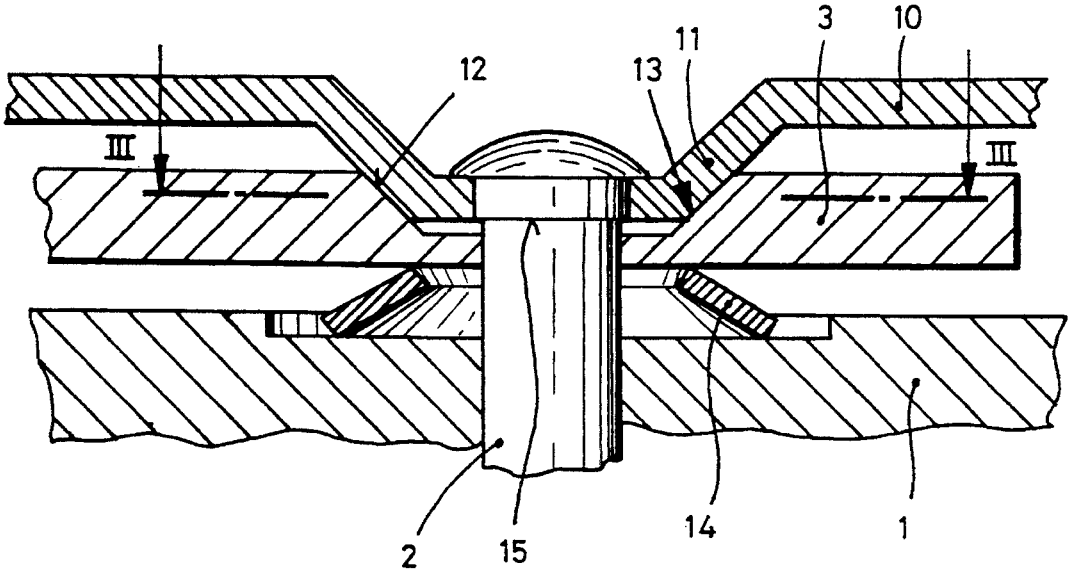
FIG. 2 is a section through a door lock in the region of its forked latch.
Figure 3:
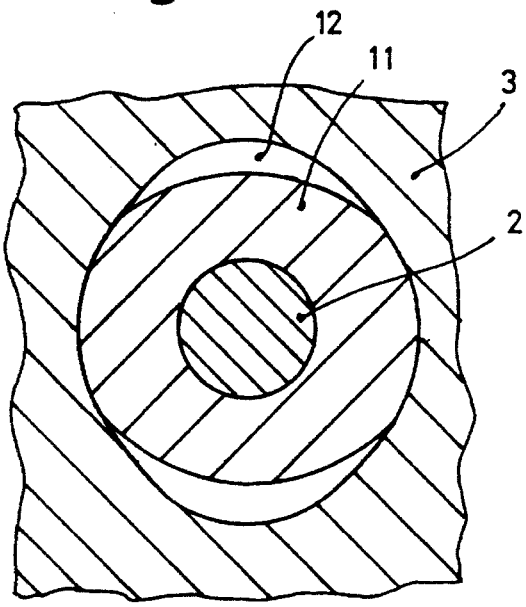
FIG. 3 is a section through the door lock along line III—III in FIG. 2 with the door closed.
Figure 4:
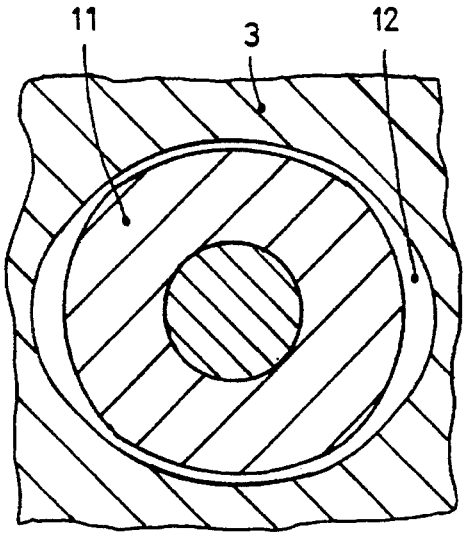
FIG. 4 is a section corresponding to FIG. 3 with the door open.

If it is desired to open the vehicle door, then by pulling on the door handle, which may be designed as a handle plate, the safety catch 9 pivots in the counterclockwise direction so that the forked latch 3 is released. In this way the spring 6 is capable of causing the forked latch 3 to pivot so far initially until its outer leg 8 comes to lie against the locking part 5. In order to prevent the creation of a loud knocking noise at this time, friction brakes acting on the forked latch 3 are provided which are shown in FIGS. 2 through 4. During the subsequent further opening of the vehicle door the lock housing 1 moves with the door to the left as shown in FIG. 1 while the forked latch 3 pivots in the counter-clockwise direction.

The sectional representation shown in FIG. 2, compared to FIG. 1 on a greatly enlarged scale, shows a partial region of the lock housing 1 with the axis 2 on which the forked latch 3 is arranged. This axis 2 which is designed as a rivet holds a cover plate 10 on the side of the forked latch 3 opposite the lock housing 1 which engages with an oval-shaped conical component 11 a correspondingly shaped oval recess 12 in the forked latch 3. The recess 12 together with component 11, because of the truncated conical surfaces lying one top the other, forms a friction brake 13 which inhibits the ability of the forked latch 3 to pivot in the region of its closed position.

The braking force of the friction brake 13 is determined by a spring 14, designed as a disk spring in this version, which is supported on the lock housing 1 and which holds the forked latch 3 under tension in the direction of component 11. A collar 15 on the axis 2 permits the forked latch 3 to exercise a slight axial stroke in the direction of the cover plate 10.

In the closed position of the forked latch 3 shown in FIGS. 2 and 3, the geometrical axes of largest diameter in each case of the recess 12 of the forked latch 3 and the component 11 extending into it are offset from one another by 90°, as FIG. 3 illustrates, above all. When the forked latch 3 is to move out of the closed position into the open position, then friction occurs between the component 11 and the truncated conical wall of the recess 12. After a relatively slight pivoting of the forked latch 3 in the opening direction the recess 12 comes free of component 11, since the directions of the oval shape come closer together and the forked latch 3 can move axially only up to the collar 15. In the open position shown in FIG. 4 the forked latch 3 is thus capable of pivoting without braking. Therefore it is assured that the forked latch 3 will always rapidly and reliably reach its end position.

The embodiments of the invention in which an exclusive property or privilege is defined is claimed as follows:

1. In a motor vehicle door lock of the type having a forked latch pivotally mounted between a lock housing member and a lock cover member by an axle for pivotal movement of the forked latch between an open position in which the forked latch is held under tension by a spring and a closed position in which the forked latch engages a locking part of the door and is retained in the closing direction by a safety catch operated by a door handle, the improvement comprising:

a spring bearing on the forked latch to urge the forked latch against one of the members;

an oval shaped conical recess and an oval shaped conical projection provided respectively on the forked latch and the one member and interfitting with one another;

the maximum diameter of one of the recess and the projection being equal to the minimum diameter of the other so that in the closed position, the projection and recess bear upon one another to frictionally impede the opening movement of the forked latch.

2. The door lock of claim 1 further characterized by the spring being a disc spring which encircles the axle.

* * * * *